US006135464A

United States Patent [19]

Borel

[11] Patent Number: 6,135,464

[45] **Date of Patent: *Oct. 24, 2000**

[54] ENERGIZED GLIDING DEVICE, SUCH AS IN-LINE ROLLER SKATE

[75] Inventor: Rene Borel, Cran-Gevrier, France

[73] Assignee: Salomon S.A., Metz-Tessy, France

[ * ] Notice: This patent is subject to a terminal disclaimer.

[21] Appl. No.: 09/304,111

[22] Filed: May 4, 1999

Related U.S. Application Data

[63] Continuation of application No. 08/856,184, May 14, 1997, Pat. No. 5,909,885.

[30] Foreign Application Priority Data

Jun. 4, 1996 [FR] France ..... 96.07030

[51] Int. Cl.[7] ..... A63C 17/06

[52] U.S. Cl. ..... 280/11.22; 280/11.19; 36/115

[58] Field of Search ..... 280/11.19, 11.22, 280/11.23, 11.27, 11.28; 36/50.5, 88, 89, 109, 115, 117, 118, 119.1, 128, 122

[56] References Cited

U.S. PATENT DOCUMENTS 5,171,033 12/1992 Olson et al. ..... 280/11.22
5,446,976 9/1995 Donnadieu et al. ..... 36/117
5,909,885 6/1999 Borel ..... 280/11.22

FOREIGN PATENT DOCUMENTS 0465222 1/1992 European Pat. Off. .
0596281 5/1994 European Pat. Off. .
WO92/03068 3/1992 WIPO .

*Primary Examiner*—Richard M. Camby
*Attorney, Agent, or Firm*—Greenblum & Bernstein, P.L.C.

[57] ABSTRACT

A device for a gliding sport, such as an in-line roller skate, equipped with an energization device including a boot whose sole is associated with an upper plate of a frame on a lower portion of which the gliding device, such as skating wheels, are arranged. The boot has a low upper provided with a rigid rear stiffener on which an equally rigid collar is mounted for angular movement to act against a elastic return device interposed between the upper and the collar, wherein this elastic return device is biased at least during pivoting toward the rear of the collar, from a substantially vertical, median inactive position of equilibrium, and along an angular path limited in amplitude by a rear limit stop of the collar arranged on a portion of the upper, or on a corresponding portion of the collar, so as to provide an at least forward elastic return of the collar, depending on an energy the value of which is proportional to the angular travel of the upper, within a maximum limit determined by the position of the limit stop of the collar.

54 Claims, 5 Drawing Sheets

ENERGIZED GLIDING DEVICE, SUCH AS IN-LINE ROLLER SKATE

CROSS-REFERENCE TO RELATED APPLICATIONS

This application is a continuation of application Ser. No. 08/856,184, filed on May 14, 1997, now U.S. Pat. No. 5,909,885 the disclosure of which is hereby incorporated by reference thereto in its entirety and the priority of which is claimed under 35 USC 120.

This application is also based upon French application No. 96.07030, filed on Jun. 4, 1996, the disclosure of which is hereby incorporated by reference thereto in its entirety and priority of which is hereby claimed under 35 USC 119.

BACKGROUND OF THE INVENTION

1. Field of the Invention

The present invention relates to a gliding device, such as an in-line type roller skate, the gliding device including a boot whose sole is associated with an upper plate of a frame on a lower portion of which the gliding element, such as a plurality of skating wheels, are arranged, the boot including a low upper provided with a rigid rear stiffener on which an equally rigid collar is capable of supporting the user's ankle and is mounted for forward and rearward movement with respect to the rear stiffener.

2. Description of Background and Relevant Information

The aforementioned type of skate constitutes a sport in itself, and can also be adapted for the practice of skaters on ice, outside of a skating rink, but also for any athlete eager to maintain or perfect, on a tarred hard ground, cement floor, etc., techniques that are used in gliding sports, such as trail skiing, cross country skiing, ice skating, etc.

In this type of sport, it has quickly become necessary to have an energizing device capable of assisting the muscles in certain skating phases, as is already known in cross-country ski boots, for example.

Thus, it is known, in a cross-country ski boot, to energize a collar toward the rear with respect to a boot upper, via elastic return means interposed between the upper and the collar, but without limiting the amplitude. However, depending on the user's experience, control of this amplitude, therefore of the energization of the collar, is not always easily managed by the user.

Moreover, it has been noted that the control of a rear energization of the collar is essentially reserved for highly experienced skaters, and that for beginners to intermediate skaters, it is important to have an energized rear and front support, as well as a rear abutment capable of limiting the travel of the collar with respect to the upper.

Likewise, this is indispensable for a proper use of a brake when the skate is equipped therewith.

It is in view of these facts and considerations that the invention was envisioned.

SUMMARY OF THE INVENTION

The invention relates to a device for a gliding sport, such as an in-line roller skate, including a boot whose sole is associated with an upper plate of a frame on a lower portion of which the skating wheels are arranged, the boot including a low upper provided with a rigid rear stiffener on which an equally rigid collar is capable of supporting the user's ankle, surrounding the lower leg, and of moving freely forward and rearward against the elastic return device interposed between the upper and the collar, wherein this elastic device is biased at least during movement toward the rear of the collar, from a substantially vertical, median inactive position of equilibrium, and along an angular path limited in amplitude by a rear limit stop of the collar arranged on a portion of the upper, or on a corresponding portion of the collar, so as to provide an at least forward elastic return of the collar, depending on an energy the value of which is proportional to the angular movement of the upper, within a maximum limit determined by the position of the limit stop of the collar.

Furthermore, the rear limit stop is particularly important for the proper use of a brake controlled by the rearward rocking of the user's ankle.

According to another characteristic of the invention, the elastic return device is biased during movement toward the rear or the front of the collar, from the substantially vertical, median inactive position of equilibrium.

BRIEF DESCRIPTION OF THE DRAWINGS

The invention is also related to the characteristics which will become apparent upon reading the following description, and which must be considered separately and according to all of their possible technical combinations.

This description, provided by way of a non-limiting example, will help to better understand how the invention can be embodied, with reference to the annexed drawings in which.

DETAILED DESCRIPTION OF PREFERRED EMBODIMENTS

Figure 1:
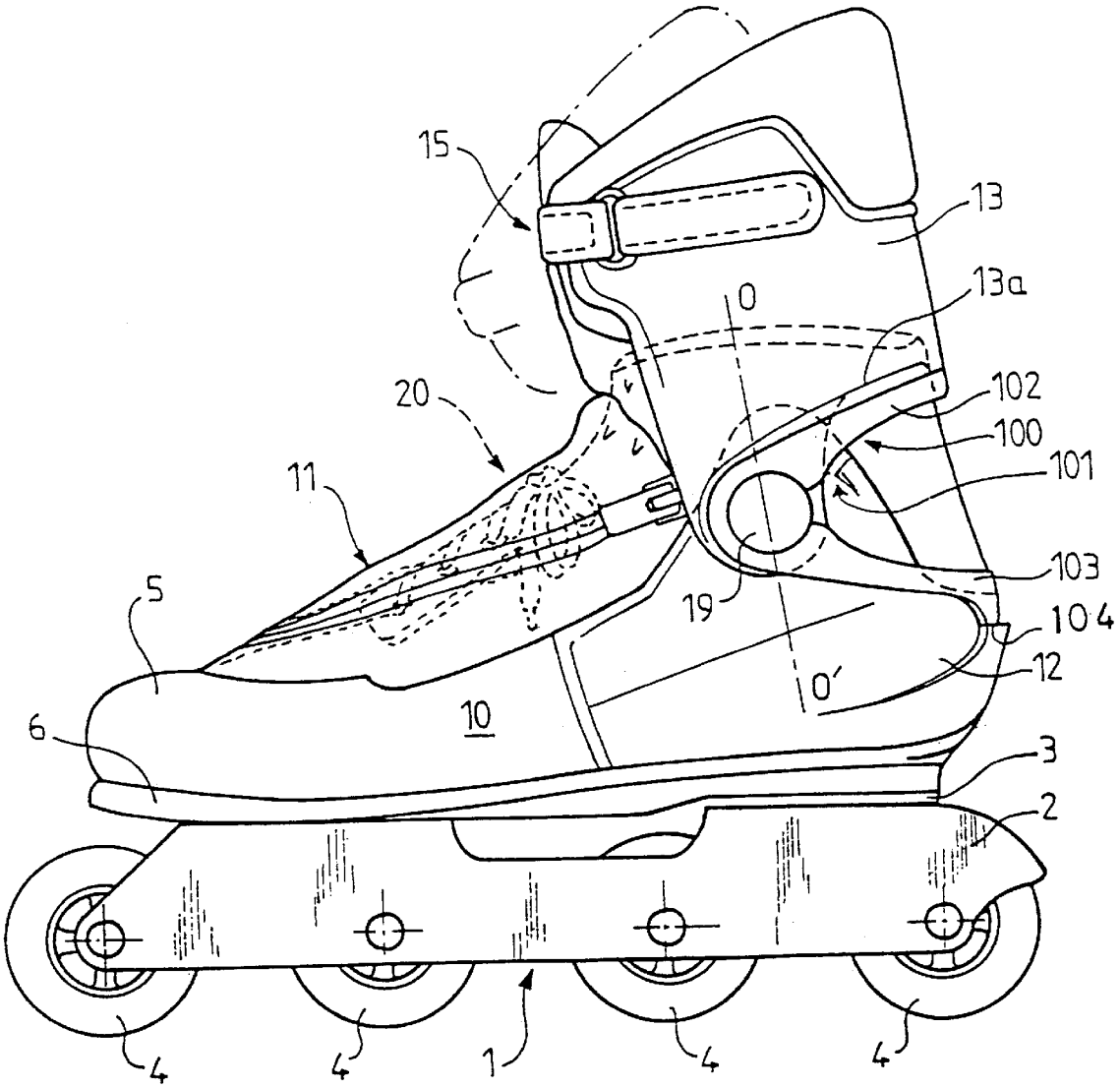
FIG. 1 is a side view of an in-line roller skate according to a first embodiment of the invention.
Figure 2:
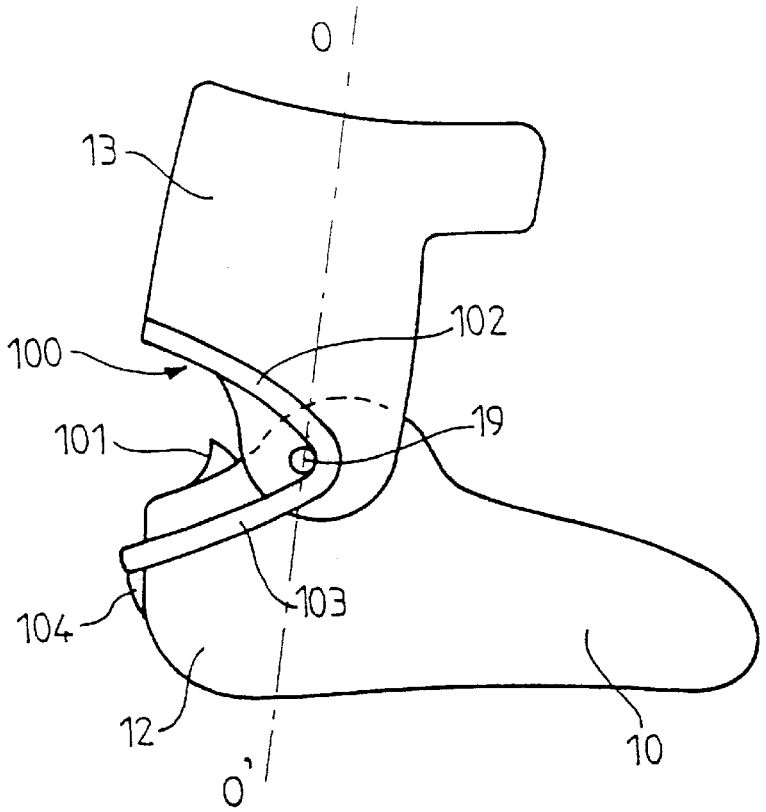
FIG. 2 schematically shows a boot according to FIG. 1.

FIG. 1 shows a gliding device and, more particularly, an in-line roller skate. The skate shown in FIG. 1 includes a frame 1 having a U-shaped cross-section with two lateral flanges 2 on which the wheels 4 are fixed, and a mounting plate 3 on which the boot 5 is attached through its sole 6.

The boot 5 has the external aspect of a normal low boot, and is therefore constituted by a low flexible upper 10, i.e., an upper whose rigid portions do not extend upwardly substantially beyond the malleoli, the upper being provided on its front portion with an opening 11 for passage of the foot and with a closure system 20 of a known type, for closure of the boot and tightening of the foot.

The upper 10 is provided in the heel area with a rigid rear stiffener 12 that can be made in any known manner and in fact constitutes the only rigid portion of the upper.

This stiffener 12 is preferably made of a rigid synthetic material and extends over the entire rear portion of the boot, around the heel thereof.

This stiffener 12 extends, in the malleoli zone, up to the top of the upper for receiving a journalled collar 13, and has, on the outside, in the area of these malleoli, an outwardly projecting boss that extends substantially perpendicularly to the wall of the stiffener.

The collar 13 could also be mounted in a different manner while allowing an easy dismounting, for example by means of a bayonet or ratchet system that is known in itself and is not described hereinafter, for the replacement of the collar or the utilization of the boot with a simple low upper.

The journalled collar 13 is embodied in this embodiment as a cuff made of a rigid material, and in particular a synthetic material such as that known by the commercial name Pebax.

This collar 13 extends upwardly to the lower part of the calf and entirely surrounds the lower part of the leg. It is open at its front portion to enable the positioning of the foot in the boot, and is provided with a tightening arrangement 15 of a known type and is formed, for example, by self-gripping device, such as Velcro or other hook-and-loop fastener.

This collar 13 is further provided at the rear with a scallop 13*a* adapted to facilitate the rearward rotation of this collar.

As can be easily understood, the substantial height of the collar 13 enables an excellent lateral leg retention during skating, such a height further allowing for a greater distribution of the reaction forces on the leg and, therefore, a better comfort for the user.

However, the height of the collar 13 does not hinder the front/rear bending movements of the leg with respect to the foot, and can even be increased, for example, until halfway up the leg so as to decrease the forces on the leg.

According to the invention, the in-line roller skate 1 shown in FIG. 1 includes an elastic return device 100 interposed between the upper 10 and the collar 13.

This device, according to the invention and in general, is biased at least during a rearward pivoting of the collar 13 from a substantially vertical, median inactive position of equilibrium 00', and along an angular travel limited in amplitude by a limit stop 101 fixedly arranged on a portion of the upper 10, or on a corresponding portion of the collar 13, so as to obtain an at least forward elastic return thereof, according to an energy whose value is proportional to the angular travel of the upper within a maximum limit determined by the position of the stop 101.

In this case, the elastic return device 100 is inactive in the median position of equilibrium 00' of the collar 13 toward the front.

Still according to FIG. 1, the elastic return device 100 is constituted by a double arm, or pin, arrangement having an upper arm 102 and a lower arm 103, respectively in abutment with the collar 13 and a rear support abutment 104 arranged on the upper 10, the pin 102–103 being biased only during a rearward pivoting of the collar 13.

The pin further passes around the journal 19 of the collar 13 in order to be maintained in place.

In this case, the forward pivoting of the collar is totally free, whereas its rearward pivoting is exerted against the elastic member 100 which, on the contrary, facilitates the return toward the front of the collar.

The elastic return member 100 could be embodied in any other way, as long as it exerts a return force on the collar during a rearward pivoting thereof. For example, it could be a different type of spring, a coil spring, an elastic buffer, etc. It is to be understood that this elastic member could also be integral or unitary with one of the elements of the upper, and could thus be constituted by an elastic arm extending from the journalled upper and cooperating with an abutment provided on the rear stiffener, or another portion of the upper 10. Conversely, it could also be an elastic arm extending from the rear stiffener of the upper and cooperating with an associated abutment of the collar.

In any event, such an arrangement tends to assist the leg muscle which controls the lifting of the tip of the foot with respect to the leg and, therefore, makes it possible to limit the fatigue of the muscle during practice of the sport.

Another important advantage of this elastic return member is that it provides the leg of the athlete with a kind of rear support having a progressive resistance, and in particular that it provides the athlete with a rearward referencing of the position of his leg, i.e., it enables him to locate the position of his leg with respect to the vertical, which information is particularly important for maintaining balance in such a gliding sport.

Finally, the provision of a rear limit stop for the collar 13 is particularly important for proper use of a brake controlled by the rearward rocking of the user's ankle.

The present invention is not limited to the embodiments described hereinabove, but encompasses all similar or equivalent embodiments.

Thus, the examples of embodiment of FIGS. 3–9, the elastic return devices 200, 300, 400, 500, 600, 700, 800, respectively, are also biased during pivoting, not only rearward but also forward pivoting of the collar 13A–13G from the substantially vertical, median inactive position of equilibrium 00' shown in these figures.

Figure 3:
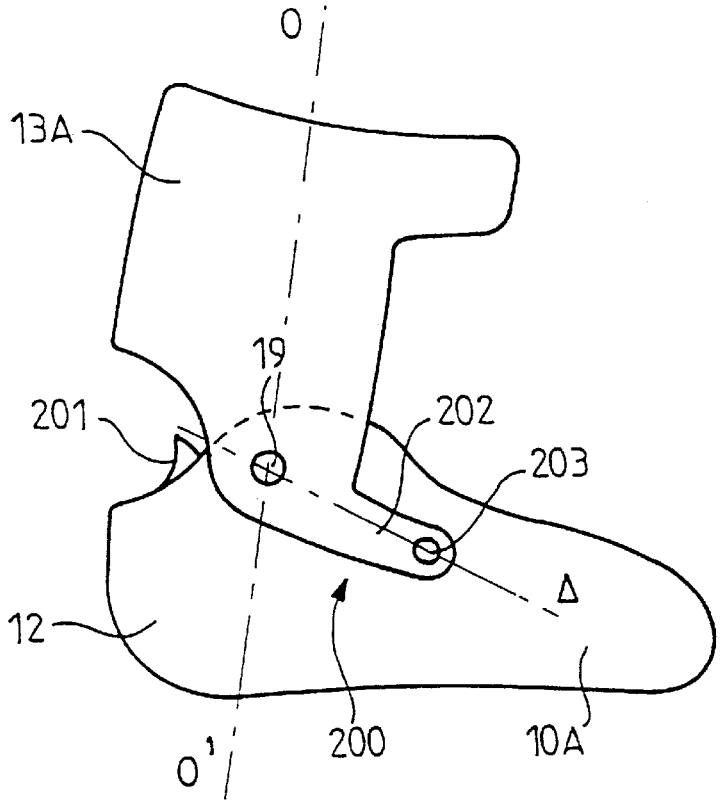
FIG. 3 schematically shows a boot according to an alternative embodiment.

More particularly, according to the example of embodiment of FIG. 3, the elastic device 200 is constituted by an energy leg 202 extending from the rigid collar 13A and extending beyond its journal 19 on the upper 10A in the direction of its front portion, the end of the leg 202 being affixed to the latter to constitute a support point 203 both during a rearward pivoting and a forward pivoting, in order to energize the leg by a value that is identical in both directions.

This energization is in fact dependent upon the quantity of material used on both sides of a line Δ joining the two journals or affixation points 19, 203, and which is biased in compression during forward or rearward bending of the collar. If this quantity of material is for example more substantial beneath the line Δ, the compression force, and therefore the energization force, will be more substantial toward the rear than toward the front.

According to the same example, a rear limit stop 201 for the collar 13A is arranged on a portion of the rear stiffener 12, opposite a corresponding portion of the collar 13A.

Figure 4:
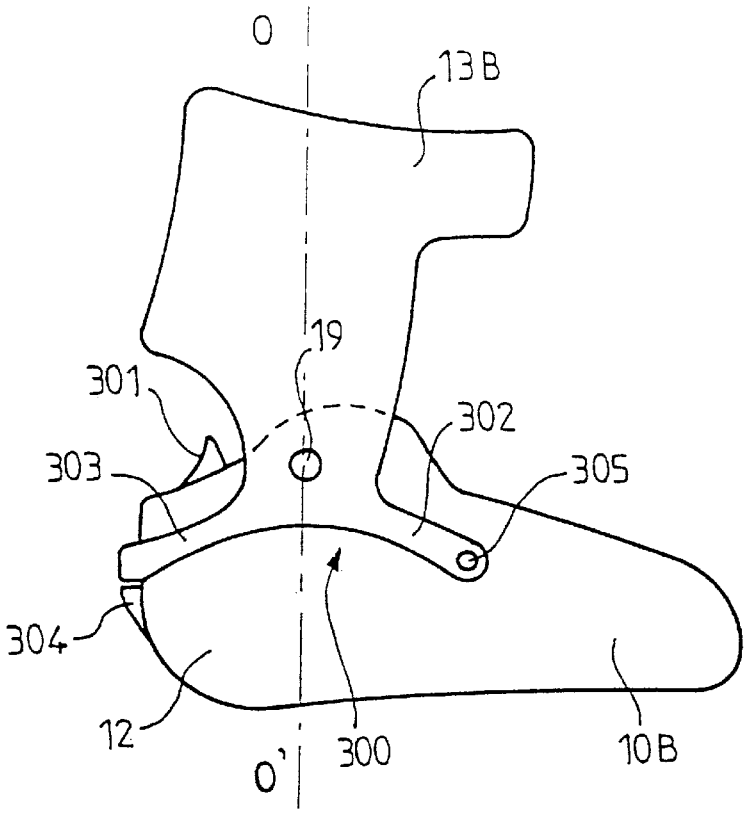
FIG. 4 schematically shows a boot according to an alternative embodiment.

According to the example of FIG. 4, the elastic return device 300 is constituted, on the one hand, by a first energy leg 302 extending from the rigid collar 13B and extending beyond its journal 19 on the upper 10B in the direction of its front portion. The end of the leg 302 is affixed to this upper 10B to constitute a support point 305, during both a rearward and forward pivoting of the collar 13B in order to energize such a leg 302 by a value that is identical in both directions. On the other hand, the elastic return device is constituted by a second energy leg 303 which also extends from the rigid collar 13B and extends beyond the same journal 19, in the direction of its rear leg, the end of the second energy leg 303 being free in angular movement, such that during a rearward pivoting of the collar 13B, the leg 303 meets a rear support abutment 304 of the upper 10B to cause energization, during a rearward pivoting of the collar 13B, of the second leg 303, this energy being added to that provided by the first leg 302.

Such a construction makes it possible to add energization toward the rear, in addition to that which is already provided toward the front, and therefore makes it possible, with simple means, to have a higher energy ratio toward the rear. This ratio will be dependent upon the type of user and could be, for example, on the order of 1–4.

According to the same example, a rear limit stop 301 is arranged on a portion of the rear stiffener 12, opposite a corresponding portion of the collar 13B.

In the two embodiments shown in FIGS. 3 and 4, the energy legs 202, 302, 303, can be made integral or unitary with the collar 13A, 13B, as shown, or can be attached, which results in the formation of the collar in a more flexible material allowing for a better enveloping of the calf, the energy legs then being made of a stiffer and elastic material.

Figure 5:
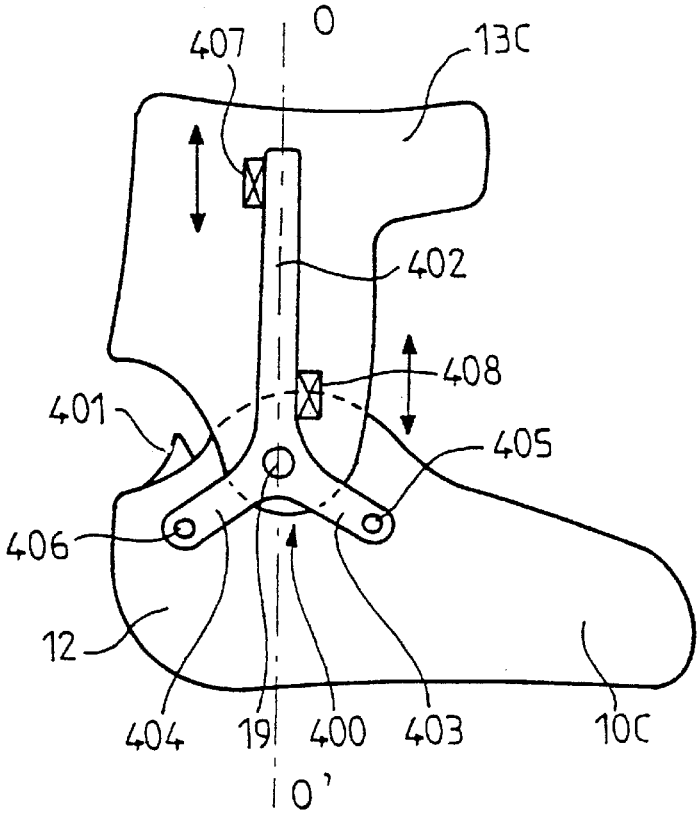
FIG. 5 schematically shows a boot according to an alternative embodiment.

According to the example of FIG. 5, the elastic return device 400 is constituted by an energy bar 402 extending freely in a substantially vertical direction, laterally to the collar 13C, from its journal and toward its upper portion, the bar 402 forming at its lower portion, from the same journal 19, two diverging legs 403 and 404, one leg 403 toward the front of the upper 10C, and the other leg 404 toward the rear, the two legs 403 and 404 being affixed to the upper to constitute a front support point 405 and a rear support point 406, so as to energize the bar 402 during forward and rearward pivoting of the collar 13C, via a front energy abutment 407 which cooperates with the energy bar 402 during forward bending of the collar 13C, and via a rear energy abutment 408 which cooperates with the energy bar 402 during rearward bending, these two abutments being arranged on the collar 13C on both sides of the bar 402.

The front 407 and rear 408 energy abutments are preferably adjustable in position along the bar 402 as a function of the desired values for front or rear energization.

Furthermore, a rear limit stop 401 is arranged on a portion of the rear stiffener 12, opposite a corresponding portion of the collar 13C. The front support point 405 could possibly be replaced by two abutments of the same type as the abutments 407 and 408.

Figure 6:
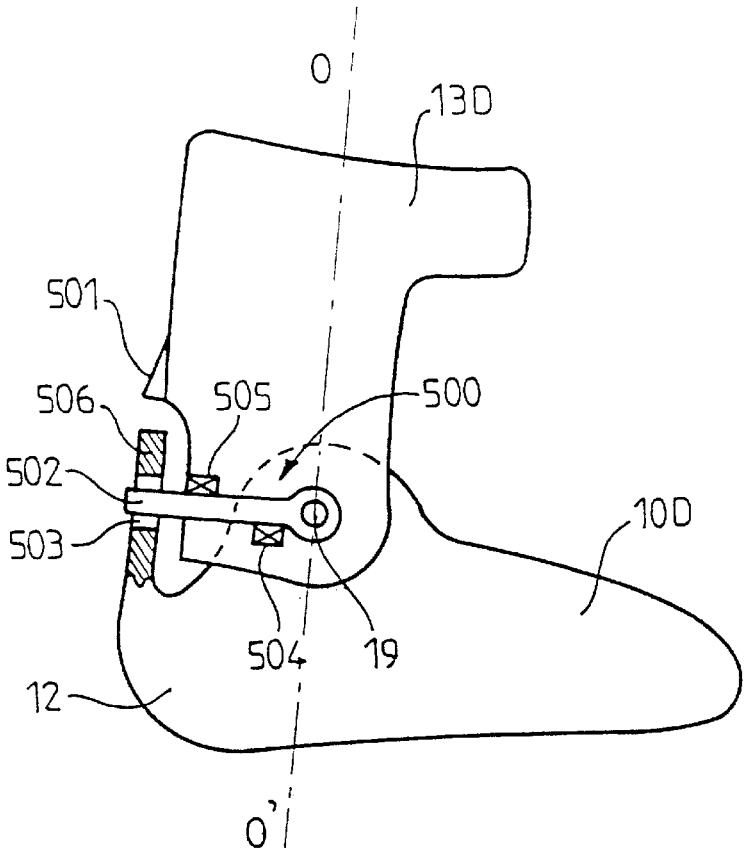
FIG. 6 schematically shows a boot according to an alternative embodiment.

According to the example of FIG. 6, the elastic return device 500 is constituted by an energy bar 502 extending freely in a substantially horizontal direction, laterally to the collar 13D, from its journal 19 and toward the rear portion of the upper 10D which includes a housing 503 through which the end of the bar 502 extends to take support upwardly and downwardly, as a function of a forward or rearward pivoting of the collar 13D, the bar 502 being energized via a front energy abutment 504 and a rear energy abutment 505 arranged on the collar 13D on both sides of such bar 502, and cooperating with the bar 502, respectively, during a forward or rearward pivoting of the collar 13D.

Likewise, the front 504 and rear 505 energy abutments are adjustable along the bar 502 as a function of the desired values for front or rear energization.

Furthermore, a rear limit stop 501 is arranged on a rear portion of the collar 13D, opposite a corresponding portion 506 of the rear stiffener.

Figure 7:
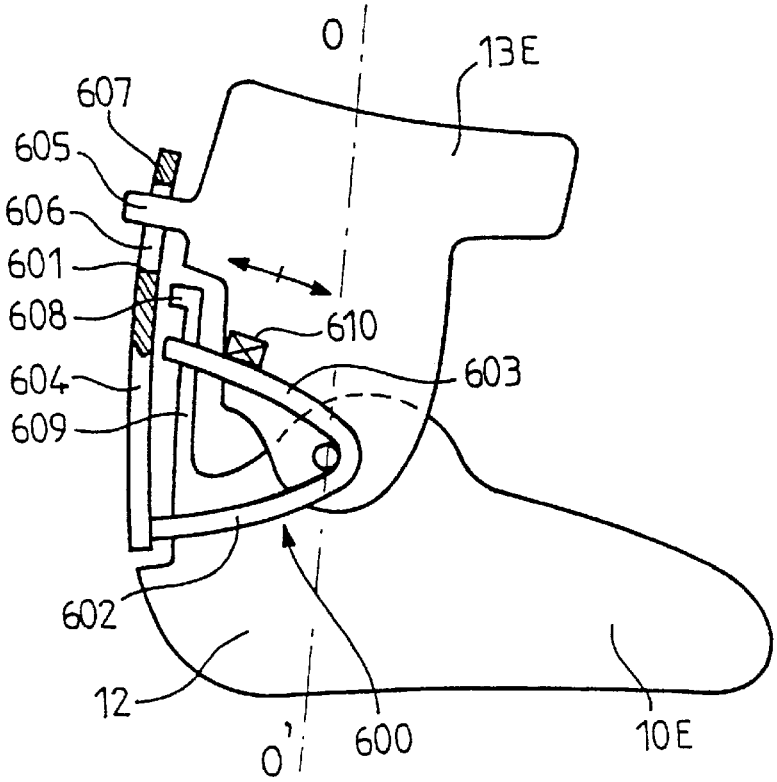
FIG. 7 schematically shows a boot according to an alternative embodiment.

According to the example of FIG. 7, the elastic return device 600 is constituted by a double pin 602–603 including a lower arm 602 affixed to a lower end of a rod 604 extending at the rear of the collar 13E with which it cooperates at its upper portion via a leg 605 that is capable of moving in a housing 606 of the rod 604 between a lower plane 601 constituting a rear limit stop and an upper plane 607 on which the leg 605 takes support during a front pivoting of the collar 13E, such support movably driving the lower arm 602 of the pin, and therefore, its second upper arm 603 until the latter enters into contact with a front energy abutment 608 obtained on a vertical extension 609 of the rear stiffener 12, from which moment the pin 602–603 is subjected to compression for a forward energization. The rearward energization also occurs by compression of the pin 602–603 obtained via a rear energy abutment 610 affixed to the collar 13E and acting on the upper arm 603 of such pin until the leg 605 comes into contact with the rear limit stop 601, constituted by the lower plane of the housing 606 for the rod 604, for a value of maximum compression in rear energization.

Likewise, the rear energy abutment 610 is adjustable along the upper arm 603 as a function of the desired value for rear energization.

Figure 8:
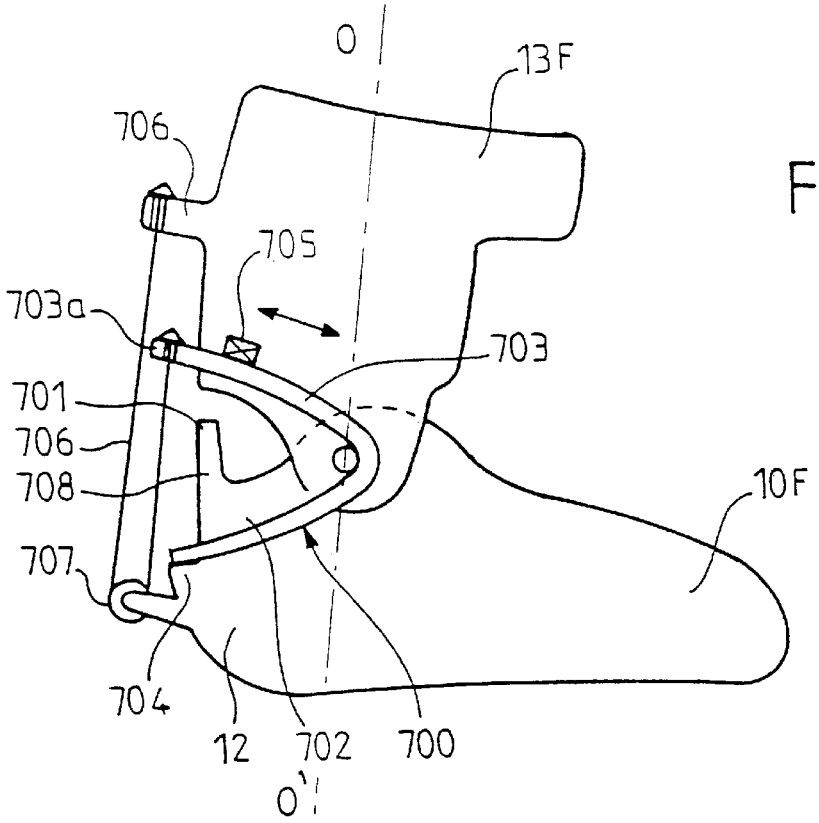
FIG. 8 schematically shows a boot according to an alternative embodiment.

According to the example of FIG. 8, the elastic return device 700 is constituted by a double pin 702–703 including a lower arm 702 that is free in forward angular movement and in rearward support against a rear support abutment 704 arranged on the stiffener 12 and against which the lower arm 702 is pressed during a rearward pivoting of the collar 13F via a rear energy abutment 705 affixed to such collar 13F and supported on the upper arm 703 of the pin to bias it in compression. The forward energization of the collar also occurs through a compression of the pin 702–703 by exerting a traction force on its upper arm 703, with a forward pivoting of the collar 13F, the lower arm 702 of the pin being into contact with the rear support abutment 704, the traction occurring via a cable 706 connected to the end 703*a* of the upper arm 703, on the one hand, and to an upper portion 706 of the collar 13F via a return pulley 707 arranged on a rear portion of the stiffener 12 of the upper 10F, on the other hand.

In this case, a rear limit stop 701 of the collar 13F is obtained with an extension 708 of the upper 10F in the direction of such collar 13F.

Figure 9:
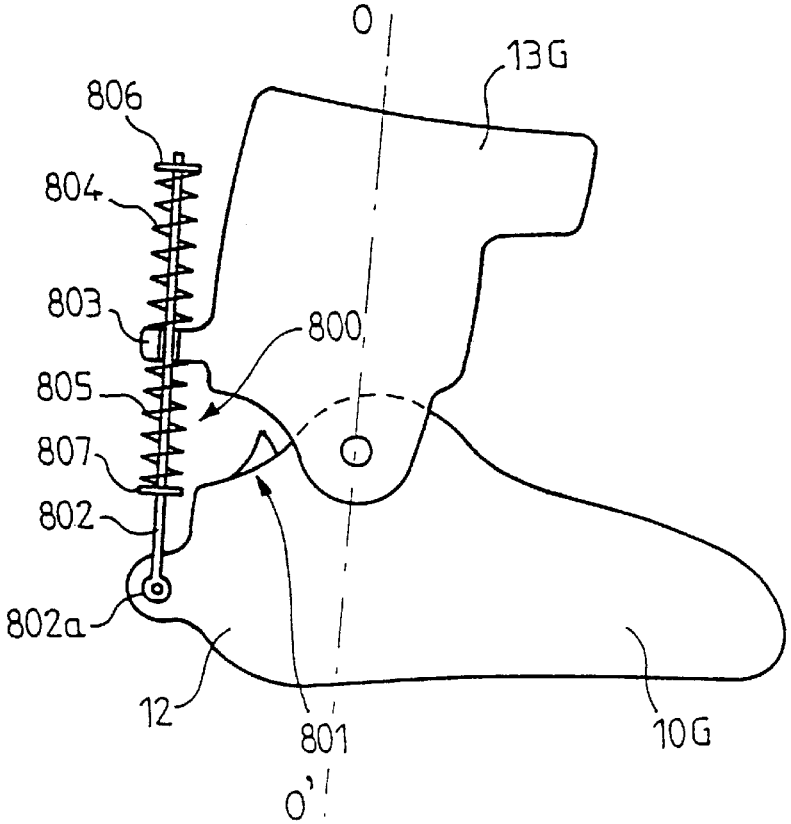
FIG. 9 schematically shows a boot according to an alternative embodiment.

According to the example of FIG. 9, the elastic return device 800 is constituted by a rear rod 802 in linkage at its lower portion 802*a* with the rear stiffener 12 of the upper 10G and freely extending through a substantially central zone, a protuberance 803 of the collar 13G constituting a front or rear energy abutment, a first front energization spring 804 being arranged on the rod 802 at its upper portion, between the central protuberance 803 and an abutment 806 of the lower end of the rod 802, whereas a second rear energization spring 805 is arranged on the rod 802 at its lower portion, between the central protuberance 803 and an abutment 807 of the upper end of the rod 802. In this way, a forward pivoting of the collar 13G compresses the first upper spring 804 for a front energization, while a pivoting of the collar 13G compresses the second lower spring 805 for a rear energization.

In this case, the position of the protuberance 803 of the collar 13G forming a front or rear energy abutment as well as the force and length of the spring 804 and 805 are defined as a function of the desired values for a front or rear energization.

Likewise, a rear limit stop 801 of the collar 13G is obtained on a corresponding portion of the upper 10G.

The present invention is not limited to the specific embodiments nor to the application of skates, such as the in-line roller skate described, but also applies to all sporting goods adapted to resolve the same problems of retaining the foot/ankle, assisting the muscles, etc.

The invention could also apply to boots having completely rigid portions of the upper.

What is claimed is:

1. A device for a gliding sport comprising:

a frame having an upper plate and a lower portion having at least one gliding element; and a boot comprising a sole affixed to said upper plate, an upper provided with a heel stiffener, and a rigid collar capable of supporting a user's ankle, a connection zone connecting said rigid collar to said heel stiffener for facilitating movement of said rigid collar between a forwardmost position and a rearwardmost position, and an elastic return device positioned between said upper and said rigid collar, said elastic return device being biased at least during said movement of said rigid collar toward the rear of the boot;

said boot further comprising a rear limit stop to limit rearward movement of said rigid collar at a particular position with respect to said heel stiffener, which provides a forward elastic return to said rigid collar according to an energy value proportional to an amount of said movement of said rigid collar, within a maximum limit determined by the position of said limit stop for said rigid collar.

2. A device for a gliding sport according to claim 1, said device being an in-line roller skate and wherein:

said at least one gliding element comprises a plurality of wheels.

3. A device for a gliding sport comprising:

a frame having an upper plate and a lower portion having at least one gliding element; and a boot comprising a sole affixed to said upper plate, an upper provided with a heel stiffener, and a rigid collar capable of supporting a user's ankle, a connection zone connecting said rigid collar to said heel stiffener for facilitating movement of said rigid collar between a forwardmost position and a rearwardmost position, and an elastic return device positioned between said upper and said rigid collar, said elastic return device being, said elastic return device comprising an elastic member made unitary with said rigid collar and being biased at least during said movement of said rigid collar toward the rear of the boot;

said boot further comprising a rear limit stop to limit rearward movement of said rigid collar at a particular position with respect to said heel stiffener, which provides a forward elastic return to said rigid collar according to an energy value proportional to an amount of said movement of said rigid collar, within a maximum limit determined by the position of said limit stop for said rigid collar.

4. A device for a gliding sport according to claim 1, wherein:

said connection zone furthermore effects movement through a median position between said forwardmost position and said rearwardmost position; and said elastic return device has a configuration, with respect to said rigid collar and said upper, for being biased only between said median position and said rearwardmost position of said rigid collar, said elastic return device being non-biased forwardly of said median portion, said median position constituting an inactive position of equilibrium.

5. A device for a gliding sport according to claim 1, wherein:

said elastic return device is constituted by a double pin comprising an upper arm and a lower arm, said upper arm being in abutment with said rigid collar and said lower arm being in abutment with a rear support abutment arranged on said upper;

said connection zone furthermore effects movement through a median position between said forwardmost position and said rearwardmost position; and said double pin has a configuration, with respect to said rigid collar and said upper, for being biased only between said median position and said rearwardmost position of said rigid collar, said elastic return device being non-biased forwardly of said median portion.

6. A device for a gliding sport according to claim 1, wherein:

said connection zone furthermore effects movement through a substantially vertical median position between said forwardmost position and said rearwardmost position; and said elastic return device has a configuration, with respect to said rigid collar and said upper, for being non-biased in said median position of said rigid collar, said median position thereby constituting an inactive position of equilibrium.

7. A device for a gliding sport according to claim 6, wherein:

said elastic return device is constituted by an energy leg extending from said rigid collar and extending beyond said connection zone on said upper in a forward direction to a front portion of said upper at an end of said energy leg, said end of said energy leg being affixed to said front portion of said upper to constitute a support point both during rearward movement and forward movement of said rigid collar in order to energize said energy leg in both forward and rearward movement.

8. A device for a gliding sport according to claim 7, wherein:

said rear limit stop is arranged on a portion of said heel stiffener, opposite a corresponding portion of said rigid collar.

9. A device for a gliding sport according to claim 6, wherein:

said elastic return device comprises a first energy leg extending from said rigid collar and extending beyond said connection zone in a forward direction to a front portion of said upper at an end of said first energy leg, said end of said first energy leg being affixed to said front portion of said upper to constitute a support point both during rearward movement and forward movement of said rigid collar in order to energize said first energy leg in both forward and rearward movement;

said elastic return device further comprises a second energy leg extending from said rigid collar and extending beyond said connection zone in a rearward direction to a rear portion of said upper at an end of said second energy leg, said end of said second energy leg being free in angular movement;

said boot further comprises a rear support abutment on said upper;

said second energy leg being positioned to engage said rear support abutment during angular movement of said second energy leg in a rearward direction to cause energization of said second energy leg, in addition to energization of said first energy leg.

10. A device for a gliding sport according to claim 9, wherein:

said rear limit stop is arranged on a portion of said heel stiffener, opposite a corresponding portion of said rigid collar.

11. A device for a gliding sport according to claim 6, wherein:

said elastic return device comprises an energy bar extending freely in a substantially vertical direction, laterally along said rigid collar, from said connection zone to an upper portion of said energy bar, said energy bar having a lower portion forming, from said connection zone, two downwardly extending diverging legs, a first of said diverging legs extending toward a front of said upper and second of said diverging legs extending toward a rear of said upper, said two diverging legs being affixed to said upper to constitute a front support point and a rear support point to energize said energy bar during forward movement and rearward movement of said rigid collar;

said boot further comprises a front energy abutment forward of said energy bar and a rear energy abutment rearward of said energy bar;

said energy bar being positioned to engage said rear energy abutment during rearward movement of said energy bar to cause energization of said energy bar and to engage said front energy abutment during rearward movement of said energy bar to cause energization of said energy bar.

12. A device for a gliding sport according to claim 11, wherein:

said front energy abutment and said rear energy abutment are movably affixed to said boot for selectively adjusting the magnitude of energization of said energy bar for each of said forward and rearward movements.

13. A device for a gliding sport according to claim 11, wherein:

said rear limit stop is arranged on a portion of said heel stiffener, opposite a corresponding portion of said rigid collar.

14. A device for a gliding sport according to claim 6, wherein:

said elastic return device comprises an energy bar extending freely in a substantially horizontal direction, laterally along said rigid collar, from said connection zone to a rear portion of said upper, said rear portion of said upper comprising a housing, said energy bar having an end portion extending through said housing, said energy bar being positioned for engagement with said housing upon a predetermined amount of movement of said rigid collar in rearward and forward directions, respectively;

said boot further comprises a front energy abutment and a rear energy abutment arranged on respective sides of said energy bar.

15. A device for a gliding sport according to claim 14, wherein:

said front energy abutment and said rear energy abutment are movably affixed to said boot for selectively adjusting the magnitude of energization of said energy bar for each of said forward and rearward movements.

16. A device for a gliding sport according to claim 14, wherein:

said rear limit stop is arranged on a portion of said heel stiffener, opposite a corresponding portion of said rigid collar.

17. A device for a gliding sport according to claim 6, wherein:

said elastic return device is constituted by a double pin comprising an upper arm and a lower arm;

said rigid collar comprises a rearwardly extending leg;

said skate further comprises a rod having a lower end affixed to said lower arm of said double pin and extending along a rear of said rigid collar, said rod having a housing within which said leg of said rigid collar extends, said housing being defined by a lower rod-engaging surface and an upper rod-engaging surface, said lower rod-engaging surface constituting said rear limit stop during rearward movement of said rigid collar;

said heel stiffener has a vertical extension with a front energy abutment;

said upper rod-engaging surface is engageable by said leg of said rigid collar during forward movement of said rigid collar and thereby driving said lower and upper arms of said double pin of said elastic return device until said upper arm engages said front energy abutment of said heel stiffener and subjecting said elastic return device to compression for forward energization;

said rigid collar having a rear energy abutment positioned thereon, said upper arm being positioned for engagement with said rear energy abutment during rearward movement of said rigid collar and thereby subjecting said elastic return device to compression for rearward energization until a maximum rearward energization occurs upon engagement of said leg of said rigid collar with said rear limit stop.

18. A device for a gliding sport according to claim 17, wherein:

said rear energy abutment is movably affixed to said boot along said upper arm for selectively adjusting the magnitude of energization of said energy bar for rearward movement of said rigid collar.

19. A device for a gliding sport according to claim 6, wherein:

said heel stiffener comprises a rear support abutment and said rigid collar comprises rear energy abutment;

said elastic return device is constituted by a double pin comprising an upper arm and a lower arm;

during rearward movement of said rigid collar said lower arm is in support against said rear support abutment and said rear energy abutment is supported against said upper arm of said double pin, whereby said double pin of said elastic return device is biased in compression during said rearward movement of said rigid collar;

said skate further comprises:

a return pulley arranged on a rear portion of said heel stiffener;

a cable connected to a rearward end portion of said upper arm, extending downwardly to said return pulley, and extending upwardly to an upper portion of said rigid collar;

during forward movement of said rigid collar said lower arm is in support against said rear support abutment, whereby said double pin of said elastic return device is biased in compression during said forward movement of said rigid collar by means of a traction force being exerted on said upper arm of said double pin via said cable.

20. A device for a gliding sport according to claim 19, wherein:

said rear limit stop is provided by means of an extension of said upper extending upwardly toward said rigid collar.

21. A device for a gliding sport according to claim 6, wherein:

said rigid collar comprises a rearwardly positioned protuberance constituting a front and a rear energy abutment;

said elastic return device comprises:

a rear rod having a lower end linked to said heel stiffener and extending upwardly, from a lower rod abutment, through a central zone, to an upper rod abutment;

a front energization spring arranged on an upper portion of said rod between said protuberance and said upper rod abutment;

a rear energization spring arranged on a lower portion of said rod between said protuberance and said lower rod abutment;

whereby forward movement of said rigid collar compresses said front energization spring for a front energization and rearward movement of said rigid collar compresses said rear energization spring for a rear energization.

22. A device for a gliding sport according to claim 21, wherein:

said protuberance is positioned on said rigid collar, and said springs have respective forces and lengths, as a function of predetermined magnitudes desired for said front and rear energizations.

23. A device for a gliding sport according to claim 21, wherein:

said rear limit stop is provided on a corresponding portion of said upper.

24. A device for a gliding sport according to claim 1, wherein:

said flexion zone comprises an area of articulation of said collar with respect to said heel stiffener; and said elastic return device is positioned at least in said area of articulation of said collar.

25. A device for a gliding sport comprising:

a frame having an upper plate and a lower portion on which at least one gliding element is arranged; and a boot comprising a sole affixed to said upper plate, an upper provided with a heel stiffener, and a rigid collar capable of supporting a user's ankle and extending around a lower leg of the user, said collar having a flexion zone connecting said rigid collar to said heel stiffener for facilitating angular movement of said rigid collar between a forwardmost position and a rearwardmost position, and an elastic return device acting between said upper and said rigid collar;

said elastic device being arranged for biasing said rigid collar during angular movement of said rigid collar toward the rear of the boot;

said boot further comprising an abutment portion, arranged on said boot to limit rearward angular movement of said rigid collar with respect to said heel stiffener, and to stop biasing of said elastic return device in a rearward direction.

26. A device for a gliding sport according to claim 25, said device being an in-line roller skate and wherein:

said at least one gliding element comprises a plurality of wheels.

27. A device for a gliding sport comprising:

a frame having an upper plate and a lower portion on which skating wheels are arranged; and a boot comprising a sole affixed to said upper plate, an upper provided with a heel stiffener, and a rigid collar capable of supporting a user's ankle and extending around a lower leg of the user, said collar having a flexion zone connecting said rigid collar to said heel stiffener for facilitating angular movement of said rigid collar between a forwardmost position and a rearwardmost position, and an elastic return device acting between said upper and said rigid collar, said elastic return device comprises an elastic member made unitary with said rigid collar;

said elastic device being arranged for biasing said rigid collar during angular movement of said rigid collar toward the rear of the boot;

said boot further comprising an abutment portion, arranged on said boot to limit rearward angular movement of said rigid collar with respect to said heel stiffener, and to stop biasing of said elastic return device in a rearward direction.

28. A device for a gliding sport according to claim 25, wherein:

said flexion zone comprises an area of articulation of said collar with respect to said heel stiffener; and said elastic return device is positioned at least in said area of articulation of said collar.

29. A device for a gliding sport according to claim 25, wherein:

said heel stiffener is more rigid than all other parts of said upper.

30. A device for a gliding sport comprising:

a frame having an upper plate and a lower portion on which skating wheels are arranged; and a boot comprising:

a sole affixed to said upper plate;

an upper comprising a relatively rigid heel stiffener having a shape to extend laterally along and behind a heel of a user;

a relatively rigid collar having a shape to surround a lower part of the leg of a user;

a connection zone connecting said rigid collar to said heel stiffener to facilitate angular movement of said rigid collar with respect to said heel stiffener;

an elastic return device positioned to act between said upper and said rigid collar, said elastic return device being biased at least during said angular movement of said collar rearwardly from a median inactive position of said rigid collar to provide a forward elastic return force to said rigid collar; and a rear limit stop, separate from said elastic return device, to limit rearward angular movement of said rigid collar with respect to said heel stiffener, thereby defining a rearwardmost position of said rigid collar, said rear limit stop being arranged on said boot and, in all positions of said rigid collar forward of said rearwardmost position, said rear limit stop being spaced from a surface to be engaged with said rear limit stop.

31. A device for a gliding sport according to claim 30, said device being an in-line roller skate and wherein:

said at least one gliding element comprises a plurality of wheels.

32. A device for a gliding sport according to claim 30, wherein:

said rear limit stop is affixed to said upper and is engaged by a part of said elastic return device upon rearward pivoting of said rigid collar.

33. A device for a gliding sport according to claim 30, wherein:

said rear limit stop is affixed to said upper and is engaged by a part of said rigid collar upon rearward angular movement of said rigid collar.

34. A device for a gliding sport according to claim 30, wherein:

said rear limit stop is affixed with respect to said elastic return device and is engaged by a part of said rigid collar upon rearward angular movement of said rigid collar.

35. A device for a gliding sport according to claim 30, further comprising:

a brake.

36. A device for a gliding sport according to claim 30, wherein:

said upper is a low upper, extending upwardly to an area substantially corresponding to a user's ankle.

37. A device for a gliding sport according to claim 36, wherein:

said heel stiffener is more rigid than all other parts of said low upper.

38. A device for a gliding sport according to claim 30, wherein:

said flexion zone comprises an area of articulation of said collar with respect to said heel stiffener; and said elastic return device is positioned at least in said area of articulation of said collar.

39. A device for a gliding sport comprising:

a frame having an upper plate and a lower portion on which skating wheels are arranged; and a boot comprising:

a sole affixed to said upper plate;

an upper comprising a relatively rigid heel stiffener having a shape to extend laterally along and behind a heel of a user;

a relatively rigid collar having a shape to surround a lower part of the leg of a user;

a connection zone connecting said rigid collar to said heel stiffener to facilitate angular movement of said rigid collar between a forwardmost position and a rearwardmost position;

and an elastic return device positioned to act between said upper and said rigid collar, said elastic return device being biased at least during a said angular movement of said rigid collar rearwardly from a median inactive position of said rigid collar to provide a forward elastic return force to said rigid collar; and a rear limit stop to limit said rearward angular movement of said rigid collar with respect to said heel stiffener at a particular magnitude, thereby defining said rearwardmost position of said rigid collar, said rear limit stop being arranged on said boot and, in all positions of said rigid collar forward of said rearwardmost position, said rear limit stop being spaced from a surface to be engaged with said rear limit stop.

40. A device for a gliding sport according to claim 39, said device being an in-line roller skate and wherein:

said at least one gliding element comprises a plurality of wheels.

41. A device for a gliding sport according to claim 39, wherein:

said rear limit stop is affixed to said upper and is engaged by a part of said elastic return device upon rearward angular movement of said rigid collar.

42. A device for a gliding sport according to claim 39, wherein:

said rear limit stop is affixed to said upper and is engaged by a part of said rigid collar upon rearward angular movement of said rigid collar.

43. A device for a gliding sport according to claim 39, wherein:

said rear limit stop is affixed with respect to said elastic return device and is engaged by a part of said rigid collar upon rearward angular movement of said rigid collar.

44. A device for a gliding sport according to claim 39, further comprising:

a brake.

45. A device for a gliding sport according to claim 39, wherein:

said upper is a low upper, extending upwardly to an area substantially corresponding to a user's ankle.

46. A device for a gliding sport according to claim 45, wherein:

said heel stiffener is more rigid than all other parts of said low upper.

47. A device for a gliding sport according to claim 39, wherein:

said flexion zone comprises an area of articulation of said collar with respect to said heel stiffener; and said elastic return device is positioned at least in said area of articulation of said collar.

48. An in-line skate comprising:

a frame having an upper plate and a lower portion on which skating wheels are arranged; and a boot comprising a sole affixed to said upper plate, an upper provided with a heel stiffener, and a rigid collar capable of supporting a user's ankle and extending around a lower leg of the user, said collar having a flexion zone connecting said rigid collar to said heel stiffener for facilitating angular movement of said rigid collar between a forwardmost position and a rearwardmost position, and an elastic return device acting between said upper and said rigid collar;

said elastic return device being arranged for biasing said rigid collar during angular movement of said rigid collar toward the rear of the boot;

said boot further comprising an abutment adapted to fix a portion of said elastic return device against rearward movement.

49. An in-line skate according to claim 48, wherein:

said elastic return device comprises an elastic member made unitary with said rigid collar.

50. An in-line skate according to claim 48, wherein:

said flexion zone comprises an area of articulation of said collar with respect to said heel stiffener; and said elastic return device is positioned at least in said area of articulation of said collar.

51. An in-line skate according to claim 48, wherein:

said heel stiffener is more rigid than all other parts of said upper.

52. An in-line skate according to claim 48, wherein:

said abutment comprises a limit stop positioned on said upper to fix said portion of said elastic return device against movement with respect to said upper.

53. An in-line skate according to claim 52, wherein:

said elastic return device includes an upper arm, a lower arm vertically spaced from said upper arm, and opposite lateral portions connecting said upper and lower arms in said flexion zone; and said limit stop is positioned below said upper arm and is engageable with said upper arm upon rearward movement of said collar.

54. An in-line skate according to claim 48, wherein:

said elastic return device comprises an elastic arm extending from said upper, said elastic arm cooperating with said abutment.

* * * * *